US005918734A

United States Patent [19]

Devens et al.

[11] Patent Number: 5,918,734

[45] Date of Patent: Jul. 6, 1999

[54] CIGARETTE PACKAGING WITH INTEGRAL LIGHTER RECEPTACLE

[76] Inventors: C. Scott Devens, 99 Ronald Ct., Ramsey, N.J. 07446; Robert D. Arnott, 10661 NW. 43rd and Court, Coral Springs, Fla. 33065

[21] Appl. No.: 08/910,496

[22] Filed: Aug. 4, 1997

[51] Int. Cl.[6] ..... A45F 15/00

[52] U.S. Cl. ..... 206/87; 206/85; 206/102

[58] Field of Search ..... 206/85, 86, 87, 206/94, 102

[56] References Cited

U.S. PATENT DOCUMENTS

| | | | |
|---|---|---|---|
| 1,256,549 | 2/1918 | Goodnow . | |
| 2,349,488 | 5/1944 | Dement . | |
| 2,958,416 | 11/1960 | Clark . | |
| 4,000,812 | 1/1977 | Pisarski et al. | 206/87 |
| 4,164,999 | 8/1979 | Tsukamoto | 206/91 |
| 4,165,804 | 8/1979 | Georgopoulos | 206/259 |
| 4,190,148 | 2/1980 | Schade, II et al. | 206/89 |
| 4,223,784 | 9/1980 | Kaneyasu | 206/88 |
| 4,588,076 | 5/1986 | Caputo et al. | 206/86 |
| 4,750,613 | 6/1988 | Kopp | 206/87 |
| 5,630,503 | 5/1997 | Rhodes et al. | 206/85 |

FOREIGN PATENT DOCUMENTS

| | | | |
|---|---|---|---|
| 1229398 | 9/1960 | France | 206/86 |
| 2693878 | 1/1994 | France | 206/85 |
| 3137318 | 4/1983 | Germany | 206/87 |

OTHER PUBLICATIONS

Flip Chip Technology held in conjunction with the Sixth International Tab/Advanced Packaging Symposium (held on Feb. 15–18, 1994 in San Jose, CA, USA).

*Primary Examiner*—David T. Fidel

*Attorney, Agent, or Firm*—Eckert Seamans Cherin & Mellott, LLC

[57] ABSTRACT

A package for retail distribution of cigarettes has a container sized to receive and dispense cigarettes. The container includes a cigarette lighter receptacle disposed on an outer surface of a wall of the container. The cigarette lighter receptacle includes at least an outer wall that is connected to the container by a pair of spaced side walls wherein the pair of side walls are (i) inwardly foldable so as to position the outer wall substantially flush with the one container wall when the receptacle is not being used, and (ii) outwardly deployable so as to form the cigarette lighter receptacle. Reverse foldable portions remain folded inwardly somewhat, defining a bottom stop for the lighter.

18 Claims, 3 Drawing Sheets

CIGARETTE PACKAGING WITH INTEGRAL LIGHTER RECEPTACLE

BACKGROUND OF THE INVENTION

1. Field of the Invention

The invention relates to packaging containing cigarettes for retail sale, and in particular provides a cigarette package having an integral pocket. The pocket is initially folded flat against the package and can be opened by the consumer for holding a cigarette lighter.

2. Prior Art

Cigarettes are sold in shirt pocket sized rectilinear retail containers or "packs" containing twenty cigarettes. The well known cigarette pack comprises an inner foil sheet that surrounds the cigarettes, a glued paper structural layer that forms the container, and a snugly wrapped outer layer of cellophane. In so-called soft packs the structural layer is flexible paper; the cellophane is removable around the top edge of the pack; and the foil is intended to be torn away over a limited portion of the top adjacent to a seal strip. In so-called hard packs the structural layer is paperboard; the cellophane is removable below a fold-back lid that extends part way down the sidewalls; and an inserted foil portion can be pulled away to expose the top ends of the cigarettes. Whether hard pack or soft pack, the structural layer is formed of sheet material that has been cut, folded and glued to form the pack.

A smoker must also carry a lighter or a book of matches to ignite the cigarettes. A popular option that has become standard is the disposable butane lighter, which frequently is dimensioned to have a height and width substantially the same as the height and thickness of a cigarette pack. A common annoyance occasionally experienced by cigarette smokers is the misplacement of their cigarette lighter. To reduce the possibility that the lighter will be misplaced, the lighter can be carried commonly with the cigarettes, for example inside the pack after a sufficient number of cigarettes have been removed to clear a space. Similarly, it is known in the art to provide a cigarette pack carrier or caddy that attaches to a pack of cigarettes or has a receptacle to receive the pack, and also has a receptacle for a cigarette lighter. For example U.S. Pat. Nos. 4,000,812—Pisarski et al.; 4,190,148—Schade, II et al.; 4,588,076—Caputo et al.; and 4,750,613—Kopp disclose various devices for carrying both a cigarette lighter and pack of cigarettes.

Cigarette pack and lighter caddies are advantageous in that they keep the pack and the lighter associated, but require that the smoker carry an additional piece of smoking paraphernalia. Thus, it is nearly as easy to misplace a caddy (particularly when empty) as to misplace a lighter. Additionally, many pack/lighter caddies are bulky, making them less than desirable for carrying in a smoker's pocket or purse. It would be advantageous if a more convenient and inexpensive way could be provided for smokers to carry their cigarette lighters along with their cigarette packs, without having to purchase and retain a separate carrier device.

SUMMARY OF THE INVENTION

The present invention provides an improved package for retail distribution of cigarettes, wherein a deployable lighter receptacle is built into the structural layer of the cigarette pack. The lighter receptacle initially is collapsed, preferably compressed against an inner side wall of the package, under the cellophane layer. Thus the lighter receptacle adds no bulk to the package unless the smoker decides to use it. The package has a plurality of walls, conventionally sized to receive and dispensably retain individual cigarettes. The container also includes panels defining a cigarette lighter receptacle on one of its side walls, preferably one of the thinner vertical side walls. The cigarette lighter receptacle preferably has at least an outer wall that is connected to the container by spaced side walls joined to the pack adjacent the front and rear side walls of the pack. The side walls of the receptacle are inwardly foldable to position the receptacle walls substantially flush with an inner container wall confining the cigarettes, when the receptacle is not being used. The side walls of the receptacle can be unfolded outwardly to deploy the lighter receptacle and to receive and retain the lighter.

BRIEF DESCRIPTION OF THE DRAWINGS

These and other features and advantages of the present invention will be more fully disclosed in, or rendered apparent by the following detailed description of certain preferred embodiments of the invention, which are to be considered together with the accompanying drawings in which the same reference numbers have been used to refer to like parts.

DETAILED DESCRIPTION OF THE PREFERRED EMBODIMENT

Figure 1:
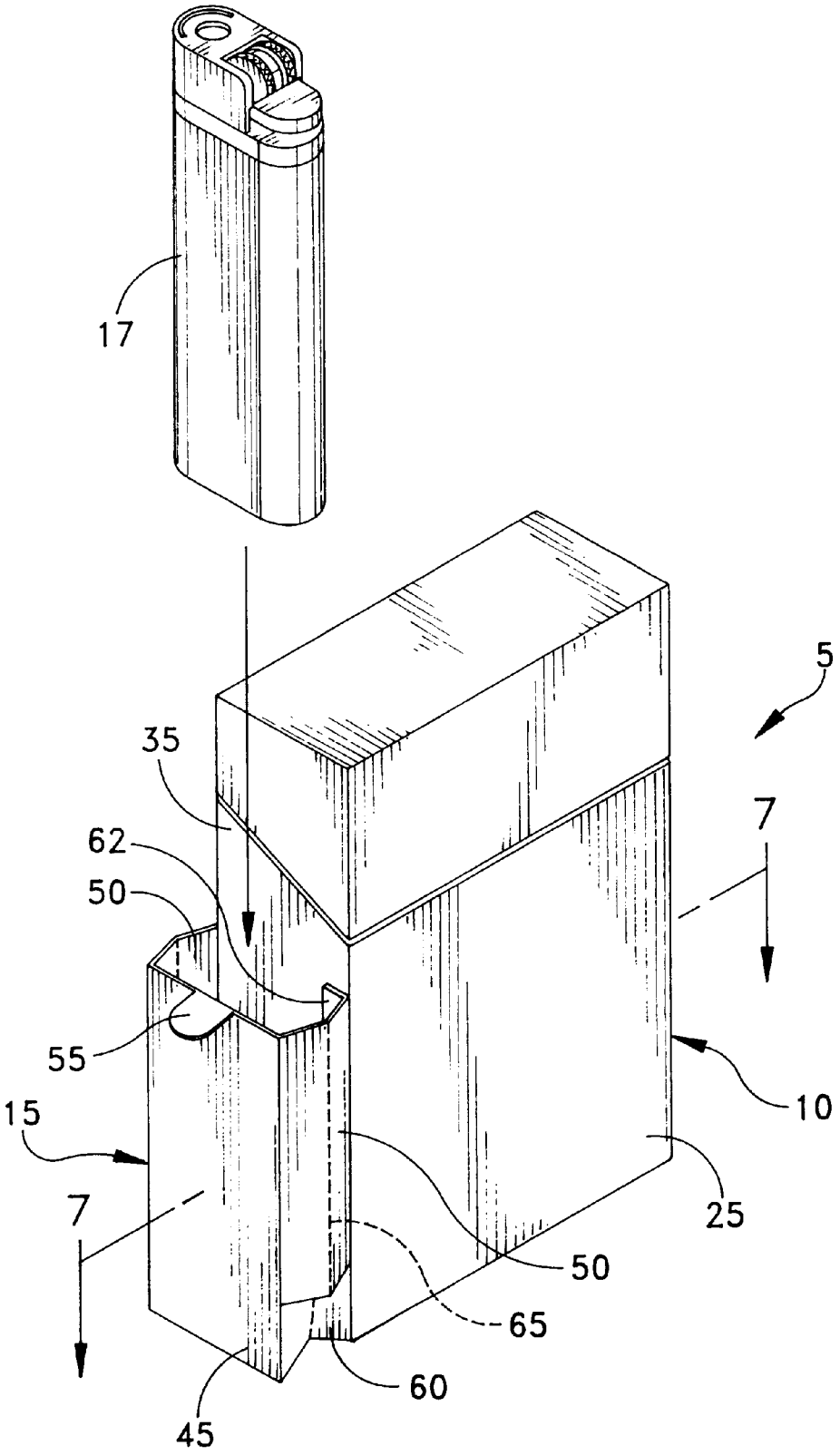
FIG. 1 is a perspective view of a box-type retail cigarette package or hard pack having a cigarette lighter receptacle according to a first embodiment of the invention.

FIG. 1 shows an inventive retail cigarette package or pack 5 having a lighter receptacle 15 formed as a part of the pack and arranged to be supplied foldably collapsed and expandable to receive a lighter 17. Cigarette pack 5 comprises a cigarette container 10 and an integral cigarette lighter receptacle 15. A conventional butane cigarette lighter 17 is also shown in FIG. 1. It will be appreciated that although an oval shaped lighter is illustrated, other shapes of lighters are known and can be used in combination with the present invention. Cigarette container 10 typically comprises a paper or paperboard material in a rectilinear box shape for holding twenty cigarettes. The packaging material is typically paper for soft packs or a less flexible paperboard or cardboard for a hard pack as shown in FIG. 1. Whether of the soft or hard variety, as shown in FIGS. 1–8 pack 5 has a top 20, a front wall 25, a back wall 30, side walls 35 and a bottom 40 (see FIGS. 4–6).

Figure 2:
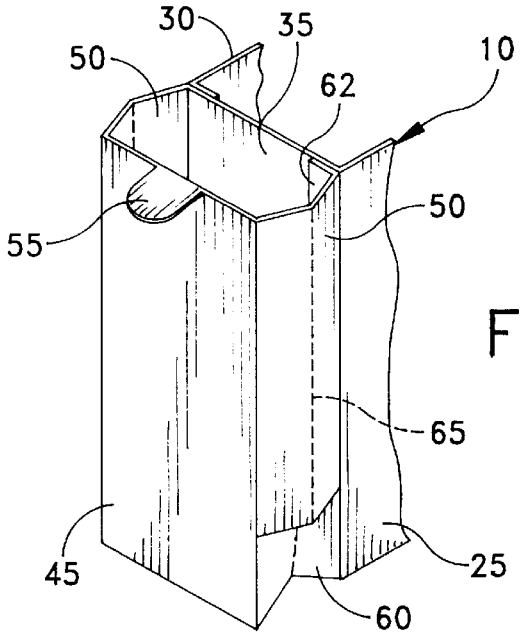
FIG. 2 is a partial perspective view of the cigarette lighter receptacle shown in FIG. 1.
Figure 3:
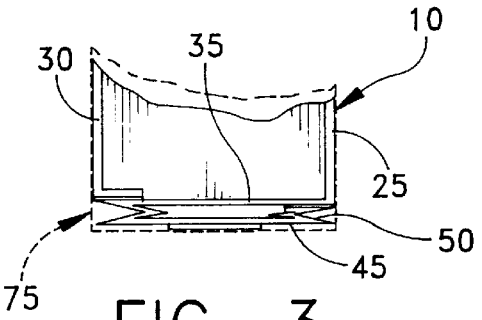
FIG. 3 is a partial top plan view of part of the retail cigarette pack shown in FIG. 1, but with the cigarette lighter receptacle in a collapsed first position where the receptacle is compressed under a cellophane wrapper.

Referring to FIG. 2, lighter receptacle 15 comprises an outer wall 45 and a pair of side walls 50. Receptacle 15 can be formed wholly integrally from the same packaging material as container 10, or can be partly attached at least partly by gluing. Outer wall 45 of receptacle 15 and side walls 50 thereof have substantially the same length (top to bottom), but outer wall 45 can advantageously be wider than either of side walls 50, such that receptacle 15 complements the typical butane lighter. Alternatively, these proportions can be varied to complement a lighter having a more circular cross section, for example as in FIG. 7. Outer wall 45 has a width approximating the width of side walls 35 of cigarette container 10. A pull tab 55 can be disposed at a top edge of outer wall 45. Side walls 50 project from the side edges of outer wall 45 and are coextensive, top to bottom, with outer wall 45.

Figure 4:
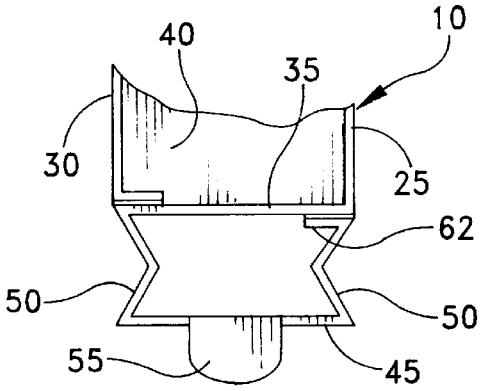
FIG. 4 is a partial top plan view similar to FIG. 3, with the cellophane wrapper removed to release the cigarette lighter receptacle, in an initial stage of opening.

As shown in FIG. 4, the sheet material formed into the pack can comprise a continuous length that is an extension of front or back wall 25 or 30. In that case at least one side wall 50 includes a flange 62 that is disposed at a free edge for affixation to container 10. In this way, container side wall 35, outer wall 45, and side walls 50 form an open ended, collapsible tube that depends from the side of container 10.

A transversely defined slit is disposed adjacent to the bottom of each side wall 50 so as to form a stop 60 (best shown in FIGS. 1, 2, 5, and 8). Each stop 60 comprises a strip of packaging material that is separated from the remainder of each side wall 50 at the slit and is attached at one end to outer wall 45 and at the other end to side wall 35 of container 10. As a result of this construction, stops 60 are free to fold inwardly, toward one another and inwardly from the position of their respective side walls 50, whereas side walls 50 are expanded outwardly, away from one another so as to open the receptacle. Stops 60 are provided near to the bottom of each side wall 50 so as to prevent a conventional cigarette lighter from sliding entirely through lighter receptacle 15, as disclosed in further detail below.

Figure 7:
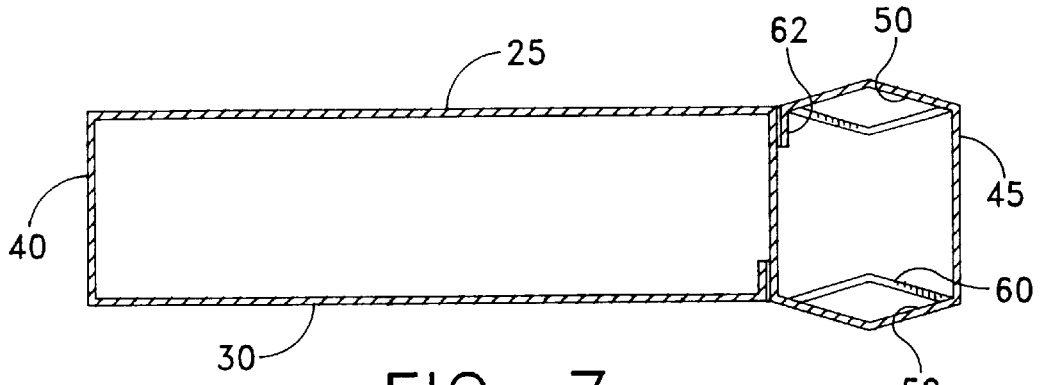
FIG. 7 is a cross-sectional view taken along lines 7—7 in FIG. 1.

It will be understood that the portion of retail cigarette pack 5 that comprises lighter receptacle 15 may be cut from a separate strip of paper or cardboard, and applied to the side of a conventional pack of cigarettes, for example with flanges 62 on both the front and rear. In the embodiment shown, however, lighter receptacle 15 and container 10 is formed as one integral unit from a single sheet or strip of paper or cardboard (FIG. 7). Often, the portion of the packaging material from which lighter receptacle 15 is formed comprises a substantially rectangular shape when opened.

Figure 8:
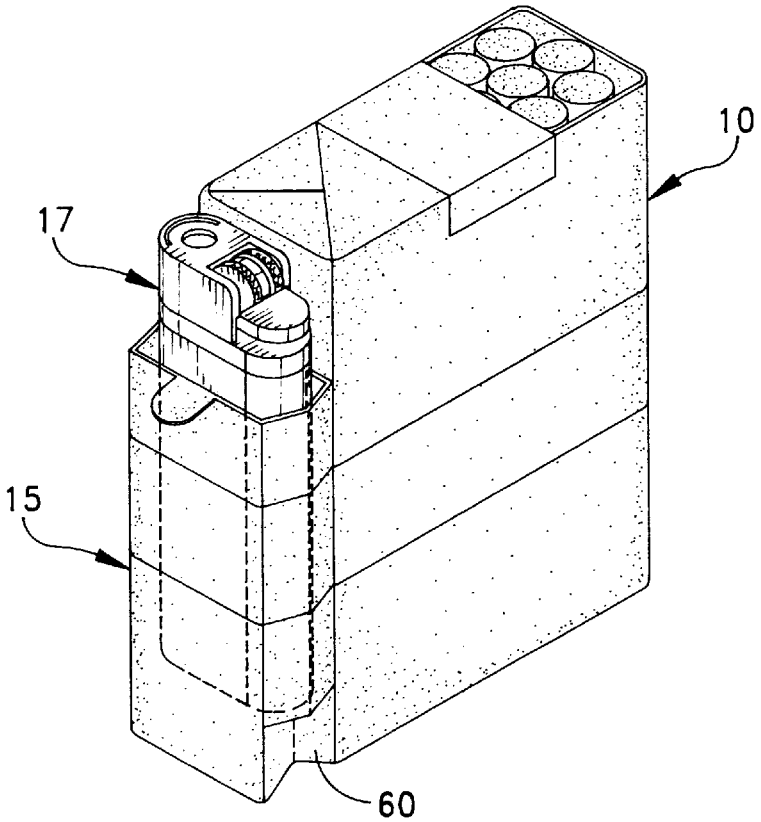
FIG. 8 is a perspective view of an alternative embodiment of the invention applied to a soft pack retail cigarette package having a cigarette lighter receptacle formed in accordance with the invention.

In order to form a retail cigarette pack 5 as shown, a portion of a single sheet of packaging material is folded so as to form an outer wall 45 between two side walls 50. An outer edge portion of one of side walls 50 is further folded longitudinally so as to form fastening flange 62. Side walls 50 of lighter receptacle 15 are also longitudinally folded, along a straight line from top to bottom, so that a pleat 65 is formed and centrally disposed between outer wall 45 and container side wall 35. As shown in FIGS. 1, 2, and 8 each pleat 65 will allow portions of side 50 to fold about the pleat so that each wall 50 can collapse inwardly toward the end wall 35 of the cigarette container 10. Once pleat 65 has been formed in each side wall 50, a transversely oriented slit is formed adjacent to one end (at the bottom) of each side wall 50 so as to form stops 60. It will be appreciated that each stop 60 contains a continuation of a respective one of the pleats 65. The remainder of the single sheet of packaging material is also folded (FIG. 7) so as to form container 10 by methods that are well known in the art. The free ends are then fastened to side portions of the package so as to complete retail cigarette pack 5.

Cigarette pack 5 is assembled for the retail sale of cigarettes by providing an interior space defined by container 10, lined with a foil wrapper and having twenty or more cigarettes disposed within the foil. Top 20 is closed so as to maintain the cigarettes in place in container 10. The loaded and closed cigarette pack 5 is snugly wrapped in a clear wrapping, as indicated by reference numeral 75 in FIG. 3. For example, cellophane is well known for maintaining retail cigarette packages sealed to ensure the freshness of the contents.

According to an inventive aspect, as the cellophane wrapper is applied to retail cigarette pack 5, a portion of the cellophane bears against outer wall 45 of lighter receptacle 15 and collapses or holds outer and side walls 45, 50 against side wall 35 of pack 10, i.e., the cellophane collapses the lighter receptacle against the cigarette container. Side walls 50 and stops 60 fold inwardly at the pleats 65 and at the corners of the lighter receptacle, into the central passageway of lighter receptacle 15. The movements of outer wall 45, side walls 50, and stops 60 cause lighter receptacle 15 to collapse substantially flush against side wall 35 of container 10. In this way, the structural elements that make up lighter receptacle 15 are folded and held securely against side wall 35 of container 10 by the cellophane wrapper during shipping and retail vending of the package of cigarettes (FIG. 3) in a conventional manner. When lighter receptacle 15 is held in this folded and collapsed state, it does not interfere with the subsequent packaging of individual packs of cigarettes into a carton, or the dispensing of packs from vending machines, etc.

Figure 5:
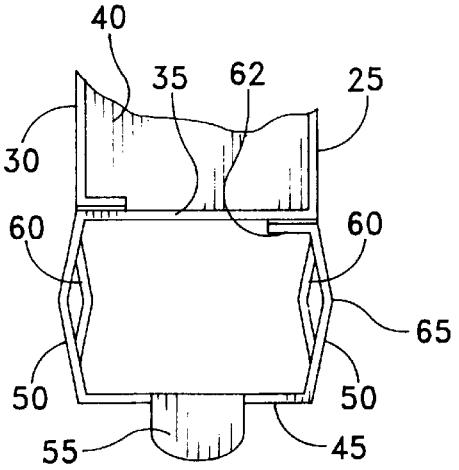
FIG. 5 is a partial top plan view similar to FIGS. 3 and 4, showing a pair of reverse foldable lighter stops.

When a smoker purchases a retail pack of cigarettes 5 that is formed in accordance with the invention, the smoker may opt to deploy lighter receptacle 15 by simply removing the entire cellophane wrapping from the pack of cigarettes. Once the cellophane wrapper is removed, the smoker need only pull outwardly on pull tab 55 so as to expand lighter receptacle 15, as shown in FIGS. 2, 4, and 5. Advantageously, the invention provides for outer wall 45 to be (i) removable between a first position in which side walls 50 are folded inwardly with outer wall 45 substantially flush to side wall 35 of container 10, and (ii) a secured position in which outer wall 45 is extended from container wall 35. More particularly, as outer wall 45 is pulled away from side wall 35 of container 10, side walls 50 of lighter receptacle 15 begin to unfold along pleat 65 and move outwardly, away from one another, so as to begin to form a substantially tubular structure, having a central passageway, on the side of cigarette pack 5 (FIGS. 1 and 8).

Figure 6:
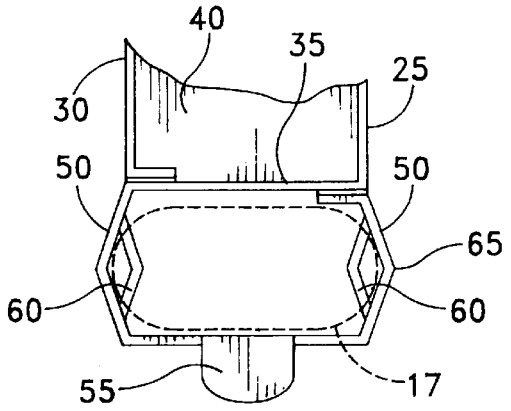
FIG. 6 is a partial top plan view similar to FIGS. 3–5, showing the cigarette lighter (in phantom) disposed in the lighter receptacle.

A conventional cigarette lighter 17 is placed into lighter receptacle 15 in the following manner. Lighter 17 is first oriented so as to align its bottom surface with the interior of lighter receptacle 15. Lighter 17 is then dropped or slid into lighter receptacle 15 so that the bottom of lighter 17 enters lighter receptacle 15 between side wall 35 of container 10, outer wall 45 and side walls 50. As lighter 17 is inserted into lighter receptacle 15, lighter receptacle 15 expands resiliently as necessary to accommodate the lighter (FIGS. 6 and 8). Whereas stops 60 are isolated from the expansion of the upper side walls by the slit, the stops 60 project inwardly relative to the upper side walls because pleat 65 remains somewhat more deeply creased at the bottom, even if side walls 50 should bulge, as a result of insertion of lighter 17 into lighter receptacle 15 (FIG. 6). Lighter 17 is slid into lighter receptacle 15 until its bottom surface abuts against inwardly protruding stops 60. Lighter 17 may be removed and reinserted into lighter receptacle 15, as often as is necessary, without falling out through the bottom opening in lighter receptacle 15.

Retail cigarette pack 5 of the invention may be formed with a lighter receptacle 15 that is formed from a separate piece of packaging material. In such an alternative embodiment, a lighter receptacle 15, that has been formed in the manner disclosed hereinabove, is fastened along its front and back free edges to a side wall of a cigarette pack. It will also be understood that the present invention may be incorporated into either a "hard pack" (FIGS. 1–7) or "soft pack" (FIG. 8) without departing from the spirit or scope of the invention.

Advantages Of The Invention

Numerous advantages are obtained through use of the present invention, which avoids the aforementioned problems associated with the prior art devices for commonly holding cigarette packs and lighters.

The improved cigarette package conforms to the standard size and shape of conventional cigarette packages when the lighter retention feature is not in use, yet allows smokers to conveniently carry their cigarette lighter along with their cigarette pack.

Also, a cigarette lighter retention feature is provided which does not require any change to the standard cigarette pack size in order to incorporate a lighter receptacle. The cigarette lighter receptacle can be collapsed flat against the side of the cigarette container, and held there by the cellophane wrapper, not affecting the dispensibility of cigarette packs or cartons from existing dispensing units dimensioned for conventional packs.

Furthermore, only those smokers that desire use of the lighter receptacle need be affected since it remains latent beneath the cellophane wrapper when not in use.

Also, an improved cigarette pack is provided wherein the cigarette lighter retention feature is created from an extension of an existing packaging material so as to provide for an inexpensive means of production and distribution of the device. This device can be used with, and created from both "soft-pack" and "hard-pack" materials as well as "regulars" and "100's".

The improved cigarette pack affords further convenience to the smoker in that the cigarette lighter receptacle is inherently disposable (with an empty pack) and does not have to be retained by the smoker, for future use, since a new lighter receptacle will be provided each time the smoker purchases a new pack of cigarettes.

The invention is by no means limited to the precise constructions herein disclosed and shown in the drawings, but also comprises such modifications or equivalents that fall within the scope of the appended claims.

What is claimed is:

1. A package for retail distribution of cigarettes comprising:

a container comprising a plurality of walls, said container being sized so as to receive and dispensably retain a plurality of individual cigarettes; and, a receptacle disposed on one of said plurality of walls of said container, said receptacle comprising at least an outer wall connected to said container by at least one side wall to form an open ended tube, wherein said side wall is (i) inwardly foldable so as to position said outer wall substantially flush with said one container wall, (ii) outwardly movable so as to deploy said receptacle, and (iii) includes a transversely oriented stop extending inwardly of the receptacle.

2. A package according to claim 1 comprising two said side walls, each having a pleat centrally disposed between said outer wall and said one container wall.

3. A package according to claim 1 wherein said stop comprises a bottom portion of at least one of said side walls bounded by a slit.

4. A package according to claim 3 comprising at least two stops, one disposed in each side wall wherein said two stops are free to move inwardly, while said side walls are moved outwardly.

5. A package according to claim 1 wherein each of said side walls comprises a pleat centrally disposed on said side wall between said outer wall and said one container wall and longitudinally extending along the length of said side wall and further wherein said side walls include a slit transversely oriented between said outer wall and said one of said container walls so as to form at least one stop adjacent to a bottom portion of said side wall.

6. A package according to claim 1 further comprising a cellophane wrapper, and wherein said cellophane wrapping material compresses said outer wall of said receptacle so as to place said outer wall in said substantially flush relation to said one container wall.

7. A package for retail distribution of cigarettes comprising:

a container comprising a plurality of walls, said container being sized so as to receive and dispensably retain a plurality of individual cigarettes; and, a receptacle disposed on one wall of said container, said receptacle comprising at least an outer wall that is connected to said container by a pair of spaced-apart side walls so as to form a collapsible tube having a central passageway sized so as to receive a cigarette lighter, wherein said pair of side walls are (i) inwardly foldable relative to said central passageway so as to position said outer wall substantially flush with said one container wall, (ii) outwardly movable so as to deploy said receptacle, and include a transversely oriented stop extending inwardly of the receptacle wherein said stop comprises a bottom portion of at least one of said side walls bounded by a transverse slit.

8. A package according to claim 7 wherein each of said side walls comprises a pleat centrally disposed on said side wall between said outer wall and said one container wall and longitudinally extending along the length of said side wall.

9. A package according to claim 7 comprising two stops said two stops are free to move inwardly while said side walls are moved outwardly.

10. A package according to claim 7 wherein each of said side walls comprises a pleat centrally disposed on said side wall between said outer wall and said one container wall and longitudinally extending along the length of said side wall and further wherein said side walls define a slit transversely oriented between said outer wall and said one of said container walls so as to form at least one stop adjacent to a bottom portion of said side wall.

11. A package according to claim 7 wherein said package for retail distribution of cigarettes is wrapped in cellophane wherein said cellophane wrapping material compresses said outer wall of said receptacle so as to place said outer wall in said substantially flush relation to said one container wall.

12. A cigarette package comprising:

a container comprising a plurality of walls and sized to receive and to dispense a plurality of individual cigarettes; and a lighter receptacle disposed on one wall of the container, said receptacle comprising an outer wall connected to the wall of the container by a pair of spaced-apart side walls to form an open ended tube, each of said side walls having a centrally disposed fold line and a transversely oriented stop formed from a bottom portion of said side wall, extending inwardly of the receptacle, said outer wall being removable between a first position in which said side walls are folded inwardly with the outer wall substantially flush to the wall of the container and a secured position in which the outer wall is extended from the container wall.

13. A package according to claim 12 wherein each of said side walls includes a slit transversely oriented between said outer wall and said one of said container walls so as to form said transversely oriented stop.

14. A package according to claim 13 wherein said stop comprises a bottom portion of at least one of said side walls.

15. A package according to claim 14 comprising two stops that are free to move inwardly while said side walls are moved outwardly.

16. A package according to claim 12 wherein said package is wrapped in cellophane wherein said cellophane wrapping material compresses said outer wall of said receptacle so as to place said outer wall in said first position.

17. A package for retail distribution of cigarettes comprising:

a container comprising a plurality of walls, said container being sized so as to receive and dispensably retain a plurality of individual cigarettes; and a receptacle disposed on one of said plurality of walls of said container, said receptacle comprising at least an outer wall that is connected to said container by a pair of spaced-apart side walls to form an open ended tube wherein said pair of side walls are (i) inwardly foldable so as to position said outer wall in substantially flush relation to said one container wall, and (ii) outwardly extensible so as to form said receptacle, wherein each of said side walls comprises a pleat centrally disposed on said side wall between said outer wall and said one container wall and longitudinally extending along the length of said side wall and said side walls define a slit transversely oriented between said outer wall and said one of said container walls so as to form at least one stop adjacent to a bottom portion of said side wall so that when said package is wrapped in cellophane prior to shipment said cellophane wrapping material compresses said outer wall of said receptacle so as to place said outer wall in said substantially flush relation to said one container wall.

18. A system for transporting smoking paraphernalia comprising:

a cigarette package comprising:

a container including a plurality of walls and sized to receive and to dispense a plurality of individual cigarettes;

a lighter receptacle disposed on one wall of the container, said receptacle comprising an outer wall connected to the wall of the container by a pair of spaced-apart side walls to form an open ended tube, each of said side walls having a centrally disposed fold line and a transversely oriented stop extending inwardly of the receptacle, said outer wall being removable between a first position in which side walls are folded inwardly with the outer wall substantially flush to the wall of the container and a secured position in which the outer wall is extended from the container wall; and, a cigarette lighter disposed in said receptacle.

* * * * *